United States Patent [19]

Avedisian

[11] 4,030,307

[45] June 21, 1977

[54] IMPERMEABLE ECOLOGICAL BARRIER AND PROCESS OF MAKING SAME FROM RECONSTITUTED SHALE

[76] Inventor: Armen G. Avedisian, P.O. Box 669, Hinsdale, Ill. 60162

[22] Filed: June 14, 1976

[21] Appl. No.: 695,461

[52] U.S. Cl. ..... 61/35; 61/36 R

[51] Int. Cl.[2] ..... E02D 15/00

[58] Field of Search ..... 61/35, 0.5, 63, 1, 2, 61/7, 36; 404/124, 75, 72

[56] References Cited

UNITED STATES PATENTS

| | | | |
|---|---|---|---|
| 2,929,219 | 3/1960 | Degen | 404/75 X |
| 3,614,867 | 10/1971 | Nieman | 61/35 |
| 3,732,697 | 5/1973 | Dickson | 61/35 |
| 3,898,844 | 8/1975 | Menard | 61/35 |

*Primary Examiner*—Dennis L. Taylor
*Attorney, Agent, or Firm*—McCaleb, Lucas & Brugman

[57] ABSTRACT

An ecologically acceptable liquid-impermeable geologic barrier is made from shale. In the process described, the preferred shale is Brainard Shale, the upper shale formation in the Maquoketa Group, which is excavated to expose solid, unweathered shale in its original sedimentary state. The Brainard shale is removed by a suitable mining operaton and crushed into an aggregate which can be readily compacted. Water is added and the shale aggregate is thoroughly mixed to uniformly disperse the water. It is immediately spread in a layer of uniform thickness along a wall to be sealed and worked and further mixed in place and compacted solid by multiple passes of a sheepsfoot roller. This is repeated in multiple lifts until the barrier reaches a desired total compacted thickness and width.

10 Claims, No Drawings

IMPERMEABLE ECOLOGICAL BARRIER AND PROCESS OF MAKING SAME FROM RECONSTITUTED SHALE

BACKGROUND OF THE INVENTION

The invention is directed to a process for making, solely from abundant natural geologic material, namely shale, an ecologically acceptable liquid-impermeable barrier or liner for use in sanitary land fill operations to seal the bottom and side walls of ground cavities to prevent contamination of underground water supplies.

Because the focal point of the invention concerns fabrication of a liquid-impermeable barrier, as for land fill operations, using reconstituted shale material widely considered useless instead of the relatively expensive blue clay conventionally used for that purpose, a detailed description of the invention will be preceded by background information on:

- certain general chemical and physical characteristics of clays and shales, their origins, similarities, and differences;
- the conventional use of blue clay as an impermeable liner, and its growing scarcity and cost, which has created a need for a less costly but effective impermeable liner for sanitary land fill operations;
- the permeability coefficient by which the effectiveness of such a liner is determined;
- the geologic background and origin of Maquoketa Group Shale used in the present invention, and its chemical and physical characteristics to the extent known; and
- the impressive number of geological agencies and departments in Federal and State Governments, and universities and schools, which have overlooked the possibility of modifying shales for use as impermeable barriers and which continue to consider shales to be of little or no practical use.

Clay is a fine-grained, earthy material composed primarily of hydrous aluminum silicates. Clay type is determined by the predominant clay mineral present (that is, kaolinite, montmorillonite, illite, etc.). Any given clay sample may be predominantly one of these minerals, or a mixture of them. Clays are plastic when sufficiently wetted, rigid (but relatively soft in comparison to rocks) when dried, and vitrified when fired at a sufficiently high temperature. Clay minerals, by definition, occur in colloidal grain sizes of 2 microns or less.

Kaolinite, a hydrous aluminum silicate, $Al_4(Si_4O_{10})(OH)_8$ is one of the most common clay minerals and is the basic raw material for the ceramic industry.

Montmorillonite is a hydrated silicate of magnesium, the chief constituent of bentonite and fuller's earth. Bentonite has a crystalline lattice arrangement giving it ihe unusual property of expanding several times its original volume when placed in water, and has some commercial uses capitalizing on this property, as in sealing compounds for filling cracks in concrete foundations (utilizing its swelling characteristic), and pet litter (using its water absorbent characteristic). Fuller's earth has the capability of decoloring oils and fats by retaining the coloring matter and is used as a filtering agent in chemical processing.

Illite, a relatively complicated silicate of potassium, aluminum, iron, and magnesium has a crystalline lattice arrangement giving it a mica-like character. Prior to this invention, which uses high illite shale, illite has had little, if any, known utility, although it is abundantly present in clays and shales.

Shale, sometimes called "mud rock", has been defined (W. H. Twenhofel, *Principles of Sedimentation*, Second Edition, McGraw Hill Book Company) as a minutely-grained sedimentary rock which is layered or laminated parallel to the bedding and in which there has been no substantial change in mineral composition since accumulation other than changes that resulted from chemical changes in place or compaction. Shales differ from clay in that they are bedded or laminated; they generally contain quartz, which imparts a rock-like hardness, making them incapable of being readily plasticized by kneading with water. In some cases, nearly identical minerals have been classified, one as clay and another as shale, solely on the basis of induration (hardness). Thus, the first observation concerning clays and shales, significant to the present invention, is that, as deposited in the earth, clays and shales are chemically similar, often differing only in physical character, mainly hardness.

Clay has been used as an impermeable lining material for wells and cisterns since Biblical times. The particular clay which has been used for this purpose is believed to be the so-called "blue clay", mostly kaolinite. It has been used to line wells and cisterns both in the as-mined, plastic state, and in the form of oven-fired bricks. The raw plastic clay and bricks have sometimes been combined, such as by use of a layer of plastic clay between the excavation wall and an inner, protective brick liner. As another application, clay dams or stoppings have been used in early underground coal mines to divert mine water from the working areas. In still another application, blue clay has been used as a water-impermeable liner on the inner faces of earth-filled dams. Blue clay, thus, has acquired the status of an approved impermeable lining material, much in demand, and costly. In the Chicago, Ill. area, for example, the cost of locally produced blue clay delivered to the site is approximately $4 per cubic yard. As will be explained, to line the bottom and side walls of a typical 200 foot deep, 50-acre excavation with blue clay to a thickness of 10 feet would cost almost $5 million for the lining material alone. As blue clay supplies are depleted close to the point of need, and haulage distances and costs increase, the cost of blue clay for this kind of large scale use will become prohibitive.

As specified in "Procedures for Testing Soils", 1964, The American Society for Testing and Materials has devised standard permeability tests from which the permeability coefficient of a particular lining material may be determined. One criterion in determining the ecological acceptability of a lining material is that it have a permeability coefficient not greater than $5 \times 10^{-8}$ centimeters per second as determined by the falling head permeability test specified in the ASTM standards. A 10 foot thick lining of material having this low permeability coefficient would, for example, delay seepage from garbage and refuse of a sanitary landfill site for so long that it would be rendered completely harmless by exposure and age.

The geological and stratigraphic sequences pertinent to the present invention are as follows: The geologic time scale beginning about 600 million years ago is divided into Paleozoic (ancient), Mesozoic (middle) and Cenozoic (recent) Eras. The present invention is directed to use of shales dating from the Paleozoic Era, which itself is divided into seven periods. Beginning with the earliest, the Paleozoic periods are designated Cambrian, Ordovician, Silurian, Devonian, Mississippian (lower carboniferous), Pennsylvanian (upper carboniferous) and Permian. Of these, the present invention relates to the last part of the Ordovician Period, which commenced about 500 million years ago and extended for 75 million years. The Ordovician Period is subdivided into three epochs, the Canadian, the Champlainian, and the Cincinnatian which was the most recent. The Cincinnatian geologic series, deposited during the Cincinnatian Epoch, includes, at the very bottom, Cape Limestone. Above the Cape Limestone, and continuing to the top of the Cincinnatian Series, is the "Maquoketa Shale Group", from which the preferred shale formation used in the present invention is taken.

The Maquoketa Shale Group is named for exposures on the little Maquoketa River in Dubuque County, Iowa. It underlies vast sections of the midwestern United States, and frequently constitutes the initial geologic layer beneath the valuable deposits of commercial Niagarian and Alexandrian dolemite and limestone which are used for highway and building construction.

Using the State of Illinois as a specific example, the Illinois Geological Survey indicates that the Maquoketa Shale Group consists of a lower unit, the Scales Shale, overlain by a middle limestone (the Ft. Atkinson Limestone), and an upper shale (the Brainard Shale). This pattern, while generally accurate, is subject to local and regional variations. For example, in Northern Illinois, an additional member of the Maquoketa Group, the Neda Formation (largely red shale interbedded with red-brown or black hematitic oolite) is locally present as the uppermost member of the group. In extreme Southwestern Illinois, to illustrate the variations caused by the general westerly uplift of the strata, only the generally lowermost segment of the group, Scales Shale, is found.

In the present invention, whereas the entire Maquoketa Shale Group is of general interest, the Brainard Shale formation, generally the uppermost member of the Group, which has been found to immediately underlie the commercial dolemite beds of Northern Illinois, is of specific interest. Prior to the present invention, there has been no known use for Brainard Shale, first, because it is too brittle and thinly laminated to support loads and, second, it readily deteriorates into dust when subjected to wet and dry weathering cycles as evidenced in the specific areas where it is exposed.

Of great significance to the discovery of useful properties of the Brainard Shale is the fortuitous geological coincidence whereby it lies directly beneath much of the commercially quarried Silurian dolomite and limestone formations. It is 75–100 feet thick where it is not deeply truncated by the sub-Silurian unconformity. It is greenish gray to green, is itself partly dolomitic in some areas, and locally silty. The Brainard Shale is commonly fossiliferous and it is identified by the presence of Cornulite fossils in its upper reaches. The Cornulite fossils are unique, having been deposited only at the close of the Ordovician Period, and serve as a tag to identify the Maquoketa Shale Group though it has sometimes been identified by other names in areas other than the central Midwest. Most important, Brainard Shale is vast, thick, and composed of almost pure illite clay particles. Published data (Illinois State Geologic Survey, Report of Investigations No. 203, 1957) indicates the clay fraction (−2 micron) of this shale is generally 90%–100% illite.

Because knowledge of the stratigraphic sequence of underground formations is of great value in the search for and development of metals, minerals, and energy resources, much detailed information has been developed and is widely known through investigations and publications of geologists and engineers associated with the U.S. Geological Survey, the Geological Surveys of the individual states, and the many state universities and colleges having geology, mining, ceramic, and engineering schools.

Despite this respectable array of talent and the very substantial sums of money which have been spent by various agencies on earth studies and evaluations of study results to identify commercially important minerals, prior to the present invention no one has developed a method for reconstituting and utilizing shales as an inexpensive substitute for clay, even considering the need and the widespread availability of these shales, and considering especially that millions of dollars may be saved on a single sanitary land fill operation by using a reconstituted shale barrier according to the present invention instead of a lining of conventional blue clay.

SUMMARY OF THE INVENTION

A general object of the present invention is to provide an ecologically acceptable liquid impermeable barrier of reconstituted shale and a process for making such a barrier to prevent the seepage of contaminating liquids into water bearing strata.

A particular object in carrying out the invention is to reconstitute a shale of the Maquoketa Group, or an equivalent shale, characterized by the presence of Cornulite fossils in the upper part thereof.

Another, more particular object, is to carry out the invention by reconstituting the Brainard Shale formation of the Maquoketa Group.

Another object is to carry out the invention by using a shale having a high illite mineral content.

DESCRIPTION OF THE PREFERRED EMBODIMENT AND METHOD

Before describing the process for applying an impermeable barrier or liner according to the present invention to a full-size land fill cavity such as a mined-out quarry, a series of pilot operations illustrating the basic steps of making the barrier, and laboratory and field tests to verify its coefficient of permeability will first be described.

Tests which confirmed the heretofore unappreciated characteristics which make maquoketa shales, when properly reconstituted, ideally suitable as a geologic liquid impervious barrier, were conducted in March, 1976 at a quarry in western Cook County, Ill. The Silurian dolemite or limestone, which had been commercially excavated at the site for nearly a century, had been removed to the bottom of the formation, about 260 feet below street grade or about elevation 400 means sea level. This exposed the upper level of the Maquoketa Group. Directly beneath the Silurian dolemite lay a 2-foot thick seam of reddish shale. This was found to be the Neda Formation, the youngest stratum of the Maquoketa Group and the contact layer between the overlying Silurian System dolemite (already mined) and the Ordovician System rocks. Immediately below this 2-foot seam was the gray-colored shale of the Brainard Formation. A log of a core hole at this specific site indicated at least a 100 foot thickness of this Brainard Formation, extending at least to elevation 292 mean sea level. Local municipal well log indicate that these shales extend to about elevation 103, means seal level, so there is no doubt that there is, at least in the area described, a vast quantity of this shale.

A quantity of this Brainard Shale was mined out by drilling and blasting and crushed to a 1½-inch maximum size. The aggregates over 1-inch size were then screened and removed and a gradation analysis, using a standard dry sieve method, was made on a typical sample. A complete summary of the data concerning the typical sample, including the gradation analysis is as follows:

Description: Shale, gray, Mohs' hardness 3.5
Geological Name: Brainard Formation, Maquoketa Group, Richmondian Stage, Cincinnatian Epoch, Ordovician System, Paleozoic Era.

| | | | |
|---|---|---|---|
| *Gradation tested (dry) | passing | 1" sieve | 100% |
| | passing | ¾" sieve | 97% |
| | passing | ½" sieve | 81% |
| | passing No. | 4 sieve | 49% |
| | passing No. | 10 sieve | 30% |
| | passing No. | 40 sieve | 12% |
| | passing No. | 100 sieve | 6% |
| | passing No. | 200 sieve | 3% |
| Natural Moisture Content (av. 2 tests) | | | 5.7% |
| Bulk Specific Gravity | | | 2.589 |
| Apparent Specific Gravity | | | 2.789 |
| Clay-Sized Particles, (−2 micron) | | | 33% |

| | |
|---|---|
| Compacted Maximum Dry Density | 140.8pcf |
| **Optimum Moisture Content | 7.3% |
| pH | 8.9 |
| Compacted Field Dry Density (av. 4 tests) | 132.1pcf |
| Compacted Field Dry Density (av. 4 tests) | 93.8% |
| Field Moisture Content (av. 4 tests) | 11.0% |
| Field Permeability Coefficient (av. 4 tests) | $3.7 \times 10^{-8}$cm/sec. |
| Laboratory Permeability Coefficient | $2.2 \times 10^{-8}$cm/sec. |
| Laboratory Density for Permeability (dry) | 137.9pcf |
| Laboratory Density for Permeability | 97.9% |
| Laboratory Moisture Content | 10.4% |
| Liquid Limit | 23% |
| Plastic Limit | 16% |
| Shrinkage Limit | 15% |

*One 3-lb. sample was tested for Gradation Analysis inaccordance with ASTM Designation C 136, Dry Sieve Method.
**The maximum density and optimum moisture of the shaleaggregate was made in accordance with ASTM Designation D 1557,Method A, and corrected for the + 1-inch aggregate removed.

A test area adjacent the quarry site was selected to demonstrate the process of reconstituting the shale aggregate into a impermeable liner, and to determine the permeability of the liner so made. An area about 10 feet × 50 feet was stripped of surface soil, down into the upper surface layer of the Niagarian dolemite which was well-weathered but provided a good solid sub-grade which was than slightly wetted using a water wagon and spray bar and uniformly well-rolled with a large rubber-tired tractor. The shale aggregate was transported to the site, placed in a pugmill, batch size of about 2 tons, and about 5% by weight water added. After thorough mixing in the pugmill had uniformly wetted the aggregate, it was immediately spread in a uniform thickness of about 6 inches loose, using a tractor-propelled Miller spreader box. When spreading the 6-inch loose lift was completed, it was rolled with a Caterpillar self-propelled sheepsfoot-type roller with tapered feet. After six to 10 passes the roller "walked" to the surface with little indentification of the feet, indicating substantially solid compaction. Six such consecutive lifts or layers were made, to a total compacted thickness of 2 – 2½ feet, and final rolling of the surface was effected with a large rubber-tired tractor.

Within 24 hours, four test holes were dug to determine the density and permeability. All testing procedures were in accordance with the United States Bureau of Reclamation Specification E-36. For details of that Specification, see "Earth Manual", United States Department of the Interior, Bureau of Reclamation, Designation E 36, 1973. The following are the pertinent data recorded from these tests, the important coefficient of permeability being on the last line, which in each case was less than $5 \times 10^{-8}$cm./sec. (described above), which verified its suitability as a liquid impermeable barrier for sanitary land fill operations.

| Hole No. | 1 | 2 | 3 | 4 |
|---|---|---|---|---|
| Date Dug | 3/24/76 | 3/24/76 | 3/24/76 | 3/24/76 |
| *Dry Density Shale | 130.3pcf | 130.0pcf | 133.0pcf | 135.2pcf |
| **Moisture Content Shale | 11.7 | 11.8 | 10.7 | 12.8 |
| Hole Diameter | 4.25" | 4.25" | 4.25" | 4.25" |
| Hole Depth | 12.0" | 12.0" | 12.0" | 12.0" |
| Water Placed for Swelling | 3/24/76, 1130 | 3/24/76, 1130 | 3/24/76, 1130 | 3/24/76, 1130 |
| Test 1 Commenced | 3/27/76, 0806 | 3/27/76, 0807 | 3/27/76, 0809 | 3/27/76, 0811 |
| Test 1 Ended | 3/29/76, 0815 | 3/29/76, 0815 | 3/29/76, 0819 | 3/29/76, 0821 |
| Av. Water Temp. | 57° F | 57° F | 57° F | 57° F |
| Total Shale Fill Thickness | 22" | 25" | 26" | 19" |
| Water Depth in Hole | 11.0" | 10.75" | 10.0" | 10.25" |
| Total Flow from Well | 75cc | 88cc | 62cc | 87cc |
| Coefficient of Permeability | $3.1 \times 10^{-8}$ cm./sec. | $4.0 \times 10^{-8}$ cm./sec. | $3.4 \times 10^{-8}$ cm./sec. | $4.2 \times 10^{-8}$ cm./sec. |

*Field density tests were made in accordance with the American SocietyFor Testing and Materials Current Standards, ASTM Designation D 2167.
**Moisture Content tests were conducted in accordance with ASTMDesignation D 2216.

Given a 10-foot thick lining of material having a permeability coefficient of $5 \times 10^{-8}$ centimeters per second, it would take approximately 200 years for liquid from a sanitary land fill to seep through it. Over that length of time, it is inconceivable that anything harmful to underground water supplies could remain in ordinary municipal refuse. Blue clay has a similar permeability coefficient and has been approved by the appropriate environmental agencies as a lining material for sanitary fill operations. Unfortunately, blue clay, as previously indicated, is in tight supply in many areas where it is needed and the cost of long-distance hauling is substantial. Therefore, a very important result of the four permeability tests reported above is that shale equivalent to that taken from the Maquoketa Group and reconstituted by crushing and compacting at the site in accordance with the present invention has a permeability coefficient low enough to suit it for use as an alternative to blue clay for sanitary land fills.

Use of the present invention, as on a full commercial scale to seal a mined-out dolomite quarry for sanitary land fill, for stowing municipal refuse, is believed apparent from the above description. Breifly, however, assume the quarry is located over shales equivalent to the Maquodeta Group described and that the quarry bottom is at the level of the top of the high illite shale corresponding to the Brainard Formation, which can be varified by chemical and geologic studies, and particularly by the presence of Cornulite fossils in the upper layer. In this case, because the Maquoketa Shale is itself impermeable, only a lining for the vertical walls need be made. For this purpose, the shale is mined by drilling and blasting, crushed and screened to a readily compactable progressive range of sizes, from about ¾ inches to less than 200 mesh, which has been dound satisfactory for compaction. The aggregate is then mixed with approximately 5% water in a known pugmill and spread to a depth of about 6 inches between the quarry wall and a suitable temporary retaining form set back about 10 feed from the quarry wall by using a tractor-propelled known Miller spreader box. Next, the loose, wet aggregate is compacted with a known sheepsfoot roller until it is essentially solid as evidenced by the feet or teeth of the roller "walking" to the top of the lift. Repeated layers are made in this way to build the wall to a usable height, according to progress of the land fill operation. If the quarry or other cavity does not have a Maquoketa shale or other sufficiently impermeable base, the entire floor should first be lined with the compacted shale using the same procedure as described for the vertical walls.

In view of the above, Maquoketa Shale, or an equivalent shale under another name, reconstituted at the site according to the process of the present invention, is a practical alternative to blue clay for use as an impermeable liner. Further, it is abundant, being distributed throughout the United States. According to the Illinois State Geologic Survey, "Handbook of Illinois Stratigraphy", Bulletin 95, 1975, Maquoketa Shale occurs under different names in different places; for example, it is described as being equivalent to Collingswood and Queenston strata in Ontario and New York, to the Sylvan Shale in the Southwest, and to the Reedsville Shale and the Sequatchie Formation to the south and southeast of Illinois. Regardless of its local name, there is an identifier which is believed unique to the shales of the Maquoketa Group by whatever name known. This is the presence of Cornulite fossils in the upper part, comprising wht is known as the Brainard Formation in the Midwest. For a further, detailed discussion of the Maquoketa Group, And Cornulite Fossils as an identifier, reference should be made to the Iowa State Geological Survey Annula Report, Volume 39, 1928, Library of Congress Number L-557.77/2.

An extremely useful and fortunate geologic coincidence is that the Maquoketa Group immediately underlies many of the Silurian dolemite and limestone beds in which commercial quarries are located. Further, since the Maquoketa group, particularly the Brainard Formation at the top, has a permeability coefficient in the natural state which is much less than the $5 \times 10^{-8}$ centimeters per second presently required for compliance with environmental protection standards for impermeable sanitary landfill linings, it provides a highly acceptable natural impermeable bottom wall, making it necessary to apply the lining to only the side walls, eliminating the expense of sealing the bottom. For example, to line the bottom and side walls of a 200 foot deep 50-acre quarry with blue clay 10 feet thick, at $4 per yard, would cost almost $5 million for the material alone. To line the side walls only, with Maquoketa Shale reconstituted from the bottom of the quarry of the quarry in accordance with the present invention, at an estimated maximum cost of $1.50 per yard, the material would cost less than $700,000.

As stated above, shales are generally regarded as having little utility. They lack strength essential for load support, they deteriorate rapidly when exposed to weathering cycles and are not commonly associated with useful minerals or ores (though there are oil bearing and uranium bearing shales for which no economically feasible commercial uses have been found). For these reasons there is much about the chemical and physical properties of shales that is unknown.

Although it is not completely understood why the process of this invention so successfully produces an impermeable liner, it is believed to result from the fact that the shales employed have a compactibility somewere between that of clay and crushed limestone. As is well known, wetted clay is plastic and readily compactible into a substantially impermeable state by a sheepsfoot roller. On the other hand, crushed limestone will never compact to such a degree. It remains porous even when emplaced with a vibrating roller and is therefore useful as a load-supporting, drainable base for concrete foundations and slabs.

Shale, or "mudstone" as it is sometimes called, is basically clay (comprising water-dispersible, colloidal particles of −2 microns) locked in place by a rigid matrix of quartz, which gives it a rock-like configuration. Unlike clay, it does not readily platicize when wetted. It has to be crushed to free some of the clay content. Thus, in the present process, a secondary crushing and mixing action takes place, when the crushed and wetted aggregate is compacted at the site by the sheepsfoot roller. This secondary crushing and mixing progressively breaks up the crushed shale pieces into smaller and smaller pieces, constantly exposing new surfaces and releasing the clay content in a wide variety of sizes by smearing, rubbing, and abrading their mud-like faces against one another. Further, the preferred Maquoketa Group Shale used in this process contains a high percentage of illite which is mica-like, characterized by numerous, closely spaced basal cleavage planes enabling the wetted illite mineral to slough off readily during the final compaction under the sheepsfoot roller. Thus, the primary mixing in the crusher and pugmill, and the secondary crushing and mixing under the sheepsfoot roller, together create a very side range of lump and particle sizes, enabling the tiniest mica-like illite clay particles to be compacted into the voids between larger ones, these in turn to be compacted into the voids between still larger ones, etc. As described, the sheepsfoot roller rides right to the top of the lift after a very few passes, indicating the high degree of compaction obtained. It is believed that the combination of brittleness in the shale, and tendency for the small particles to break up and slough off and form a semi-mud causes almost as much degradation under the sheepsfoot roller feet as in the pugmill when the water is added. At any rate, regardless of the scientifically precise explanation, it is possible by practicing the process of this invention to remove shale, particularly the Brainard Shale Formation of the Maquoketa Group, from its natural, impermeable state, and reconstitute it to an ecologically acceptable liquid impermeable barrier for use as a liner in sanitary land fill operations.

The embodiments of the invention in which an exclusive property or privilege is claimed are defined as follows:

1. A process for reconstituting shale to make an ecologically impermeable geologic barrier along a wall comprising the steps of:

a. primarily crushing solid, as-mined shale selected from the group consisting of Maquoketa Group shale, a shale identified by the presence of Cornulite fossils in the upper part thereof, and shale which is high in illite mineral content, to produce a readily compactible aggregate having a progressive gradation of sizes;

b. mixing water with said shale to provide a wetted aggregate;

c. spreading said wetted aggregate along said wall; and d. secondarily crushing and mixing said wetted aggregate in place against said wall to compact it to a substantially solid, impermeable state.

2. A process according to claim 1 in which said barrier is compacted to a coefficient of permeability of less than $5 \times 10^{-8}$ centimeters per second.

3. A process according to claim 1 in which said aggregate has a gradation of sizes progressively varying from plus 3/4 inch to minus 200 mesh.

4. A process according to claim 1 in which the largest size of said aggregate passes through a 1 -inch screen.

5. An ecologically impermeable geologic barrier for a ground cavity including bottom and side walls comprising compacted reconstituted shale disposed along at least the side walls of said cavity, said shale selected from the group consisting of Maguoketa Group shale, a shale identified by the presence of Cornulite fossils in the upper part thereof, and shale which is high in illite mineral content.

6. An ecologically impermeable geologic barrier according to claim 5 wherein the bottom wall of said ground cavity is comprised of said shale in its natural solid state, said shale having a coefficient of permeability of less than $5 \times 10^{-8}$ centimeters per second.

7. A process for reconstituting shale to make an ecologically impermeable geologic barrier along a wall comprising the steps of:

a. primarily crushing solid, as-mined shale identified by the presence of Cornulite fossils in the upper part thereof, to produce a readily compactible aggregate having a progressive gradation of sizes;

b. mixing water with said shale to provide a wetted aggregate;

c. spreading said wetted aggregate along said wall; and d. secondarily crushing and mixing said wetted aggregate in place against said wall to compact it to a substantially solid, impermeable state.

8. A process for reconstituting shale to make an ecologically impermeable geologic barrier along a wall comprising the steps of:

a. primarily crushing solid, as-mined shale high in illite mineral content, to produce a readily compactible aggregate having a progressive gradation of sizes;

b. mixing water with said shale to provide a wetted aggregate;

c. spreading said wetted aggregate along said wall; and d. secondarily crushing and mixing said wetted aggregate in place against said wall to compact it to a substantially solid, impermeable state.

9. A process for reconstituting shale to make an ecologically impermeable geologic barrier along a wall comprising the steps of:

a. primarily crushing solid, as-mined Maquoketa Group shale, to produce a readily compactible aggregate having a progressive gradation of sizes;

b. mixing water with said shale to provide a wetted aggregate;

c. spreading said wetted aggregate along said wall; and d. secondarily crushing and mixing said wetted aggregate in place against said wall to compact it to a substantially solid, impermeable state.

10. A process according to claim 9 in which said shale is from the Brainard Formation of the Maquoketa Group.

* * * * *

UNITED STATES PATENT OFFICE

CERTIFICATE OF CORRECTION

Patent No. 4,030,307 Dated June 21, 1977

Inventor(s) Armen G. Avedisian

It is certified that error appears in the above-identified patent and that said Letters Patent are hereby corrected as shown below:

Column 1, line 56, "ihe" should be "the"
Column 2, line 38, "Ill." should be "Illinois
Column 4, line 52, "maquoketa" should be "Maquoketa"
line 15); line 55, "Ill." should be -- Illinois -- ;
line 60, "means" should be -- mean -- (
Column 5, line 5, "log" should be -- logs --
line 4 "means seal" should be -- mean sea --
line 2); line 62 "a" should be -- an --
line 67, "than" should be -- then --
Column 6, line 10, "10" should be -- ten --
line 11 "indentification" should be -- indentation --
line 22 "1973" should be -- 1963--

Column 7, line 5, "varified" should be -- verified --
line 12 "dound" should be -- found--
line 17 "feed" should be -- feet --
line 38, "Collingswood should be
-- Collingwood -- line 46 "wht"
should be -- what -- line 48
"And" should be -- and --
line 50 "Annula" should be — Annual --

UNITED STATES PATENT OFFICE

CERTIFICATE OF CORRECTION

Patent No. 4,030,307 Dated June 21, 1977

Inventor(s) Armen G. Avedisian

It is certified that error appears in the above-identified patent and that said Letters Patent are hereby corrected as shown below:

Column 8, line 1 (second occurrence) delete "of"; line 2 delete "the quarry" line 18 "were" should be -- where --
line 44 "clev-" should be -- cleav- ---
line 7); line 50 "side" should be -- wide --

In the Heading, par. [76] line 2, "Hinsdale" should be -- Hillside --.

Signed and Sealed this

*Twenty-ninth* Day of *August 1978*

[SEAL]

*Attest:*

RUTH C. MASON
*Attesting Officer*

DONALD W. BANNER
*Commissioner of Patents and Trademarks*